US008991653B2

(12) United States Patent
Paulitsch et al.

(10) Patent No.: US 8,991,653 B2
(45) Date of Patent: Mar. 31, 2015

(54) TAPPING HEAD, TAPPING DEVICE AND METHOD FOR USE OF A TAPPING DEVICE

(75) Inventors: Helmut Paulitsch, Gratz (AT); Alfred Donabauer, Linz (AT)

(73) Assignee: Heineken Supply Chain B.V., Amsterdam (NL)

( * ) Notice: Subject to any disclaimer, the term of this patent is extended or adjusted under 35 U.S.C. 154(b) by 392 days.

(21) Appl. No.: 13/058,106

(22) PCT Filed: Aug. 11, 2009

(86) PCT No.: PCT/NL2009/050488

§ 371 (c)(1),
(2), (4) Date: Apr. 8, 2011

(87) PCT Pub. No.: WO2010/019035

PCT Pub. Date: Feb. 18, 2010

(65) Prior Publication Data

US 2011/0309109 A1 Dec. 22, 2011

(30) Foreign Application Priority Data

Aug. 12, 2008 (NL) ..... 2001882

(51) Int. Cl.

| | |
|---|---|
| ***B67D 7/80*** | (2010.01) |
| ***B65D 83/00*** | (2006.01) |
| ***F25D 23/06*** | (2006.01) |
| ***F25D 3/00*** | (2006.01) |
| ***B67D 1/08*** | (2006.01) |
| ***F25D 31/00*** | (2006.01) |

(52) U.S. Cl.

CPC ..... *B67D 1/0829* (2013.01); *B67D 1/0867* (2013.01); *F25D 31/002* (2013.01)

USPC ..... 222/146.6; 222/146.1; 222/400.7; 62/451; 62/395; 62/393

(58) Field of Classification Search

USPC ..... 222/146.1, 146.6, 399, 400.7, 148; 62/298, 299, 451, 395, 457.1, 390, 62/393, 396; 165/104.19; 29/428

See application file for complete search history.

(56) References Cited

U.S. PATENT DOCUMENTS 2,048,665 A * 7/1936 Dolan et al. ..... 62/298
2,284,135 A * 5/1942 Cornelius ..... 210/448
2,771,752 A * 11/1956 Tennant ..... 62/224

(Continued)

FOREIGN PATENT DOCUMENTS

AP 1273 A 4/2004
EP 1642861 A1 4/2006

(Continued)

OTHER PUBLICATIONS

"Coupling" Merriam-Webster.com. Merriam-Webster, Aug. 8, 2013.*
"Uncouplable" Merriam-Webster.com. Merriam-Webster, May 1, 2014.*
English Translation of Ito, JP 06263193 A, Sep. 1994.*

*Primary Examiner* — J. Casimer Jacyna
*Assistant Examiner* — Benjamin R Shaw
(74) *Attorney, Agent, or Firm* — Pearne & Gordon LLP

(57) ABSTRACT

A tapping head, provided with a connecting head near an end of a housing, wherein the tapping head is provided with at least one of a beverage channel which extends from a beverage line connection into the connecting head and a gas channel which extends from a gas line connection, wherein the tapping head is provided with at least one cooling chamber with an entrance and an exit, separate from the beverage channel and/or the gas channel, which cooling chamber is in thermal contact with the housing.

19 Claims, 5 Drawing Sheets

(56) References Cited

U.S. PATENT DOCUMENTS

| | | | | | |
|---|---|---|---|---|---|
| 4,212,414 | A | * | 7/1980 | Beyens | 222/148 |
| 4,228,927 | A | * | 10/1980 | Beyens et al. | 222/148 |
| 4,802,344 | A | * | 2/1989 | Livingston et al. | 62/372 |
| 5,956,966 | A | * | 9/1999 | Wendell | 62/389 |
| 6,360,923 | B1 | | 3/2002 | Vlooswijk | |
| 6,415,963 | B1 | | 7/2002 | Vlooswijk et al. | |
| 2006/0236714 | A1 | * | 10/2006 | Beckett | 62/393 |
| 2008/0203118 | A1 | | 8/2008 | Sauer et al. | |
| 2009/0302069 | A1 | | 12/2009 | Oberhofer et al. | |
| 2010/0176156 | A1 | * | 7/2010 | Segers | 222/146.6 |

FOREIGN PATENT DOCUMENTS

| | | | | | |
|---|---|---|---|---|---|
| EP | 1650157 | A1 | | 4/2006 | |
| EP | 1688814 | A1 | | 8/2006 | |
| GB | 396637 | A | | 8/1933 | |
| JP | 06263193 | A | * | 9/1994 | B67D 1/04 |
| WO | 0035774 | A1 | | 6/2000 | |

* cited by examiner

TAPPING HEAD, TAPPING DEVICE AND METHOD FOR USE OF A TAPPING DEVICE

The invention relates to a tapping head. The invention relates in particular to a tapping head of the handle tapping head type, provided with a connecting head for a cask.

It is generally known that for beverage, in particular for beverage containing natural ingredients such as yeast, hops and/or extracts thereof, it is advantageous to cool them prior to and preferably also during tapping. The quality of the beverage is thereby preserved and/or improved, the taste for a consumer is positively influenced and moreover contamination and in particular growth of microorganisms in the tapping device is limited.

Tapping devices are known in which a cask is set up in a refrigerator, so that the beverage is cooled. Known furthermore are tapping devices in which a beverage line leading from the cask to a tapping column is cooled, such that beverage in the beverage line is kept cool. Combinations thereof are also possible. Such tapping devices, however, are not optimal. For instance, they are relatively sizeable and costly in use, do not always lead to the desired limitation of bacterial growth and may be energetically disadvantageous.

Casks are usually connected to a tapping device, in particular a beverage line, with the aid of a tapping head. Moreover, a cask may with the same tapping head be connected to a gas line, for pressurizing beverage in the cask during use. Such tapping heads are usually also referred to as handle tapping head.

The object of the invention is to provide a tapping head for use in a tapping device for beverage, where cooling of the beverage and/or the tapping device is applied.

In an aspect, a tapping head according to this description is characterized in that it is provided with a connecting head at an end of a housing. The tapping head is provided with a beverage channel which extends from a beverage line connection into the connecting head and/or a gas channel extending from a gas line connection into the connecting head. The tapping head is provided with at least one cooling chamber having an entrance and an exit, separate from the beverage channel and/or the gas channel, which cooling chamber is in thermal contact with the housing and is provided with a cooling line connection.

In another aspect, a tapping device according to the description is characterized in that it is provided with a tapping head which is connected to a cooling line of the tapping device, which cooling line is connected to a cooling system for beverage.

In a further aspect, a method according to this description is characterized in that for cooling beverage in a tapping device coolant is guided through a portion of a tapping head, which coolant is further used for cooling the beverage in at least a part of a beverage line connecting to the tapping head.

In a still further aspect, a method according to this description is characterized in that it is intended for adapting a tapping head for cooling. Such a method can comprise the following steps:

- uncoupling a beverage line and/or gas line from a beverage line connection and/or a gas line connection of a tapping head, respectively;
- coupling a cooling chamber-containing part, provided with a beverage line intermediate piece and/or a gas line intermediate piece, with the beverage line connection and/or the gas line connection, respectively;
- coupling the beverage line and/or the gas line, respectively, with the beverage line intermediate piece and/or the gas line intermediate piece.

The order of these steps, for that matter, may be adapted and should not be construed as a fixed order.

In the claims and description, further embodiments of the invention are described.

To clarify the invention, embodiments of a cooling device and method will be elucidated in more detail with reference to the drawing. In the drawing.

Figure 1:
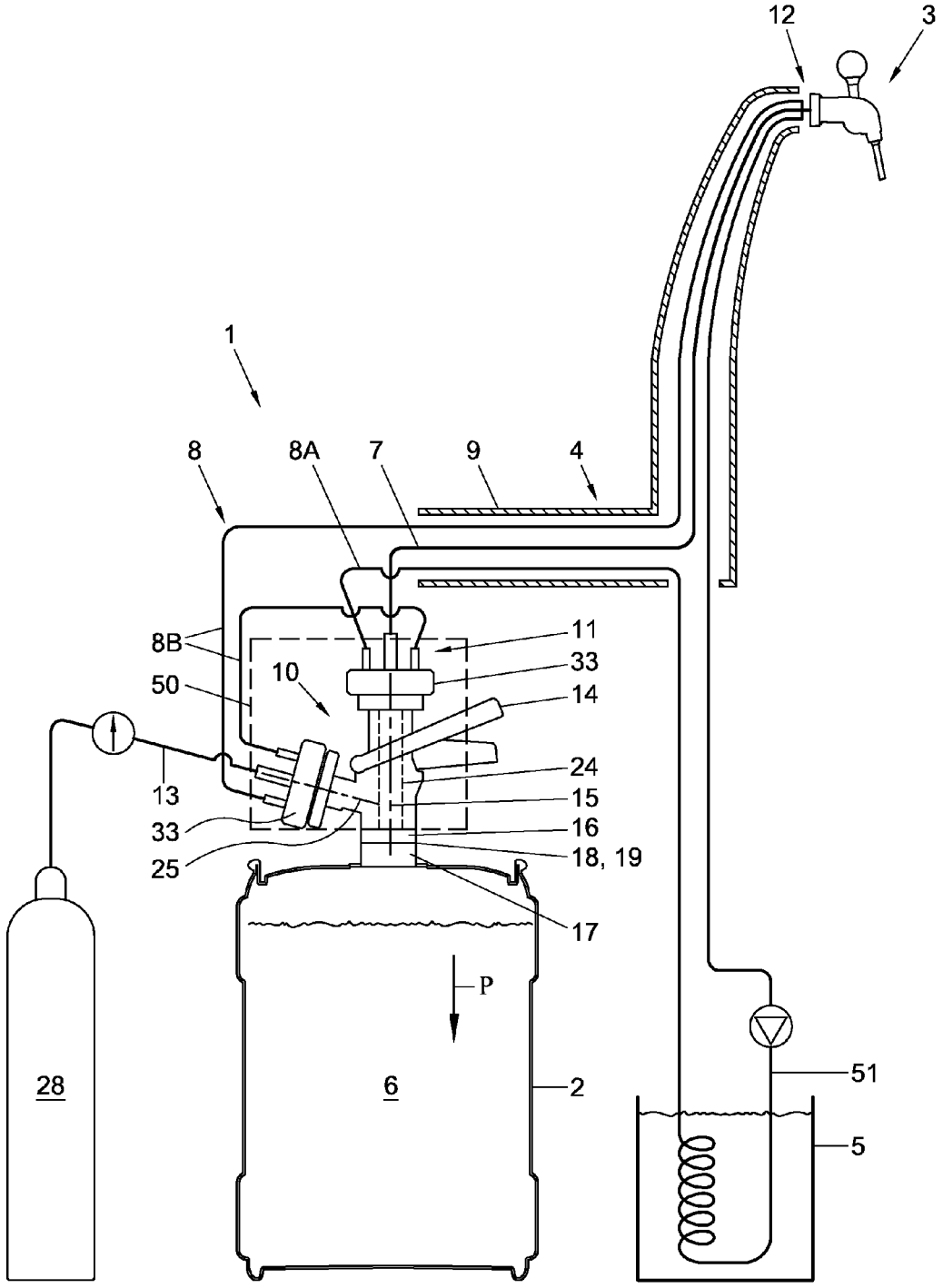
FIG. 1 shows schematically a tapping device according to the invention.

In this description, equal or corresponding parts have equal or corresponding reference numerals. The embodiments shown are shown for illustration only and should not be construed as limiting in any way. In this description, tapping head should be understood to mean at least, though not exclusively, a tapping head for connection of a beverage line to a cask. Such a tapping head may be a lever handle tapping head. Cask should herein be understood to mean at least, though not exclusively, a holder such as a container for holding beverage. This may be a cask to be used once, or more than once, such as a beer cask. Connecting should herein be understood to mean at least, though not limited to, bringing into fluid communication, for instance of two lines or of a space such as a chamber in a tapping head or inner space of a cask with a line, or coupling in such a way that such a fluid communication can be effected.

In FIG. 1 there is schematically shown a tapping device 1. This tapping device 1 is for instance suitable for tapping beer. In other embodiments, tapping devices may be provided for tapping other beverages and/or combinations of beverages. In the embodiment shown in FIG. 1, a tapping device 1 is provided with a container 2 in which beverage such as beer is stored and a tap 3 with which beer can be dispensed. Tap 3 should herein be understood to mean at least, though not exclusively, a dispensing unit for beverage such as a faucet, a valve, an operating means for operating a valve or the like provided on a tapping hose, tapping line or like dispensing line. Provided between the container 2 and the tap 3 is a line assembly 4. An embodiment thereof will be described in more detail hereinafter. A cooling device 5 may be provided between the container 2 and the tap 3, for cooling the beer 6 that has been passed out of the container 2, and/or a cooling medium. In this way, cooled beer 6 can be dispensed with the aid of the tap 3. It will be clear that different containers 2 may be provided, as well as different taps 3, while in each case at least one container 2 is connected with at least one tap 3, via the same or different line assemblies 4 or parts thereof. In the container 6, the beverage does not need to be cooled.

In the embodiment shown in FIG. 1, the line assembly 4 may be provided with a beverage line 7 and at least one cooling line 8. The at least one beverage line 7 and the at least one cooling line 8 may be jointly included in a jacket 9. The at least one beverage line 7 and the at least one cooling line 8 may be included in a collective line such as for instance a python type line assembly 4. The jacket 9 may be a thermally insulating jacket. The beverage line 7 is connected by a first end 11 to the container 2 with the aid of a tapping head 10, and connected by a second end 12 with the tap 3. In an embodiment the beverage line 7 may be guided through the cooling device 5, for instance in an in-line cooler, flow-through cooler, cooling bath, dip cooler, Peltier cooler, or like known cooling devices. In another embodiment the beverage line 7 may for instance be cooled by the cooling line 8, which to that end has been guided through the cooling device 5, as for instance shown in FIG. 1.

Figure 2:
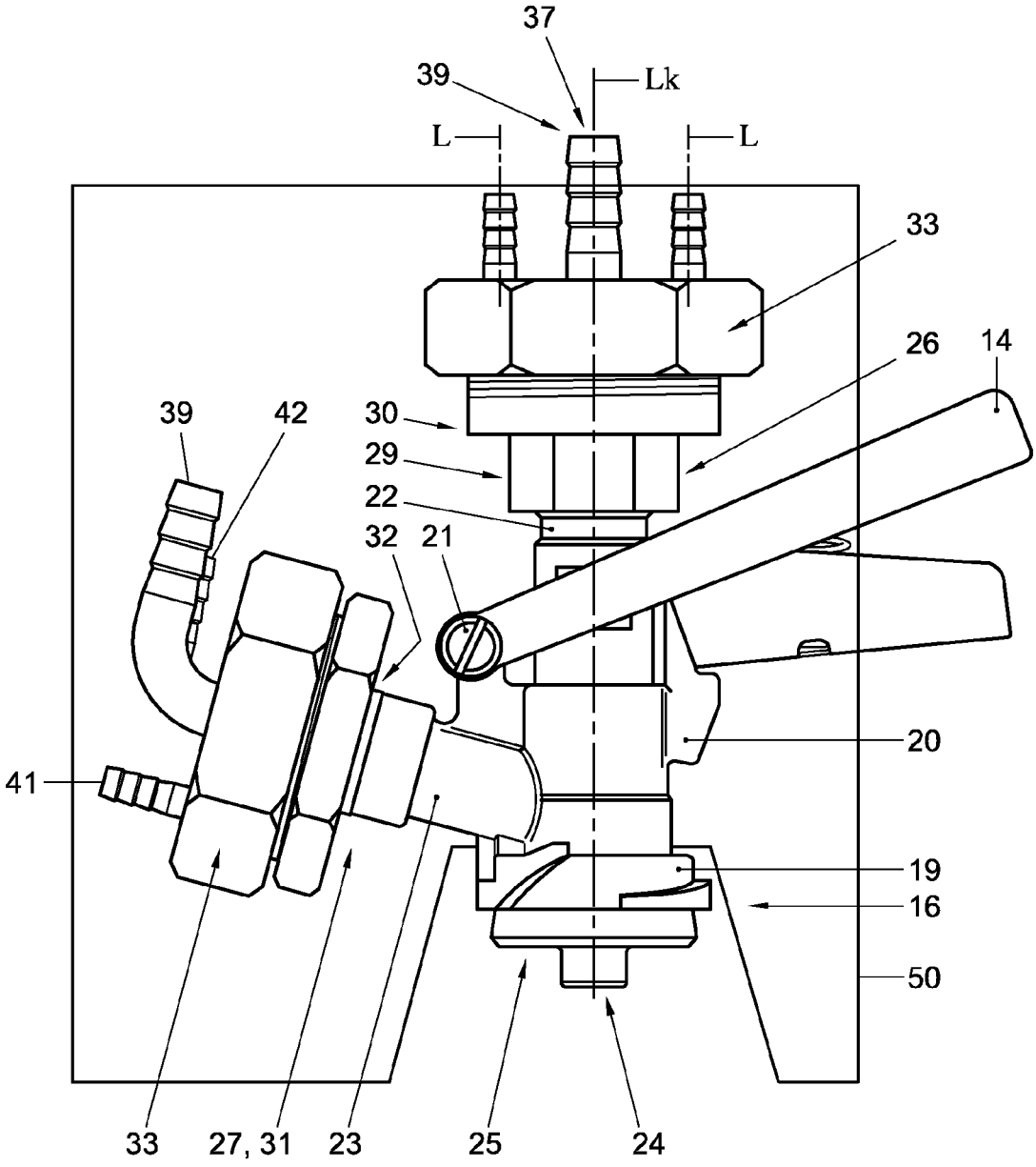
FIG. 2 shows a side elevation of a tapping head.

In FIG. 2 there is shown schematically and in side elevation a tapping head 10, for use in a tapping device 1, for instance in a tapping device 1 as shown in FIG. 1. This tapping head 10 may be substantially designed as a standard lever handle tapping head such as for instance, though not limited to, Sankey 2 or 3 lug, and/or plane-sliding tapping heads, UEC tapping heads and the like, for instance offered by Micro-Matic, DSI and/or Celli, which has been adapted for the invention, as will be described in more detail in the form of an embodiment. Via the tapping head 10, the beverage line 7 can be brought into fluid communication with the inside of the container 2. Via the tapping head 10, in an embodiment, also a gas line 13, coupled to a gas cylinder 28 such as a $CO_2$ cylinder or like gas source, may be brought into fluid communication with the inside of the container, for pressurizing beverage therein. In an embodiment a pressure regulating device may be included in the inner space of the container 2, for pressurizing the beverage and/or keeping the beverage pressurized. Examples of such pressure regulating devices are for instance given in NL 1 008 601, WO 00/35774, EP 1 688 814, EP 1 642 861 and in the non-prepublished patent applications of applicant, entitled Pressure regulator and tapping apparatus provided therewith. The tapping head 10 comprises a handle 14 with which a shaft 15 can be moved in axial direction. Upon downward movement, that is, in the direction of the container, as indicated by the arrow P, the shaft 15 opens a beverage valve and where applicable a gas valve of the container 2. Beverage can then be guided, under pressure, out of the container. When the shaft 15 is moved back up, the beverage valve and where applicable the gas valve close again. Such a tapping head 10 and the use thereof are sufficiently known.

The tapping head 10 has a connecting head 16, with which the tapping head 10 can be coupled with the container 2. To that end, the connecting head 16 is adapted to the neck 17 of the container 2 and coupling means 18 arranged therein and/or thereon. The coupling means 18 may for instance, though not exclusively, be bayonet parts, screw thread, clamping means or the like. The connecting head 16 is then provided with complementary coupling means 19. An example of the coupling means 18, 19 mentioned is for instance known as a Sankey two lug connection. Examples of other possible types have been mentioned hereinabove. A housing 20 is coupled to or integrally formed with the connecting head 16. The shaft 15 is retained in the housing. The handle 14 is pivotably coupled to the housing 20 via a shaft 21. The housing 20 comprises a first end piece 22, for instance opposite the connecting head 16, and a second end piece 23, for instance on a side of the tapping head 10. A beverage channel 24 extends through the housing 20, from the connecting head 16 along and/or through the shaft 15 into the first end piece 22. A gas channel 25 extends from the connecting head 16 along a part of the shaft 15, through the housing 20, into the second end piece 23. The first end piece 22 is provided with a beverage line connection 26, the second end piece with a gas line connection 27.

In a use of a tapping head 10 as known from the prior art, the beverage line 7 is connected directly to the beverage line connection 26, while the gas line 13 is then connected directly to the gas line connection 27. To this end, the beverage line connection 26 is provided with first coupling means 29 and the beverage line 7 with complementary first, counter coupling means 30, while the gas line connection 27 is provided with second coupling means 31 and the gas line 13 with second, complementary counter coupling means 32. The first and second coupling means 29, 31 and counter coupling means 30, 32 can for instance form screw means, bayonet couplings, rapid couplings or like couplings known per se. As a non-limiting example, couplings 29, 30, 31, 32 are shown as applied in the tapping head 10 of a type described earlier. In an embodiment, the first and second coupling means 29, 31 are designed as internal thread, the first and second counter coupling means 30, 32 as complementary external thread.

Figure 3:
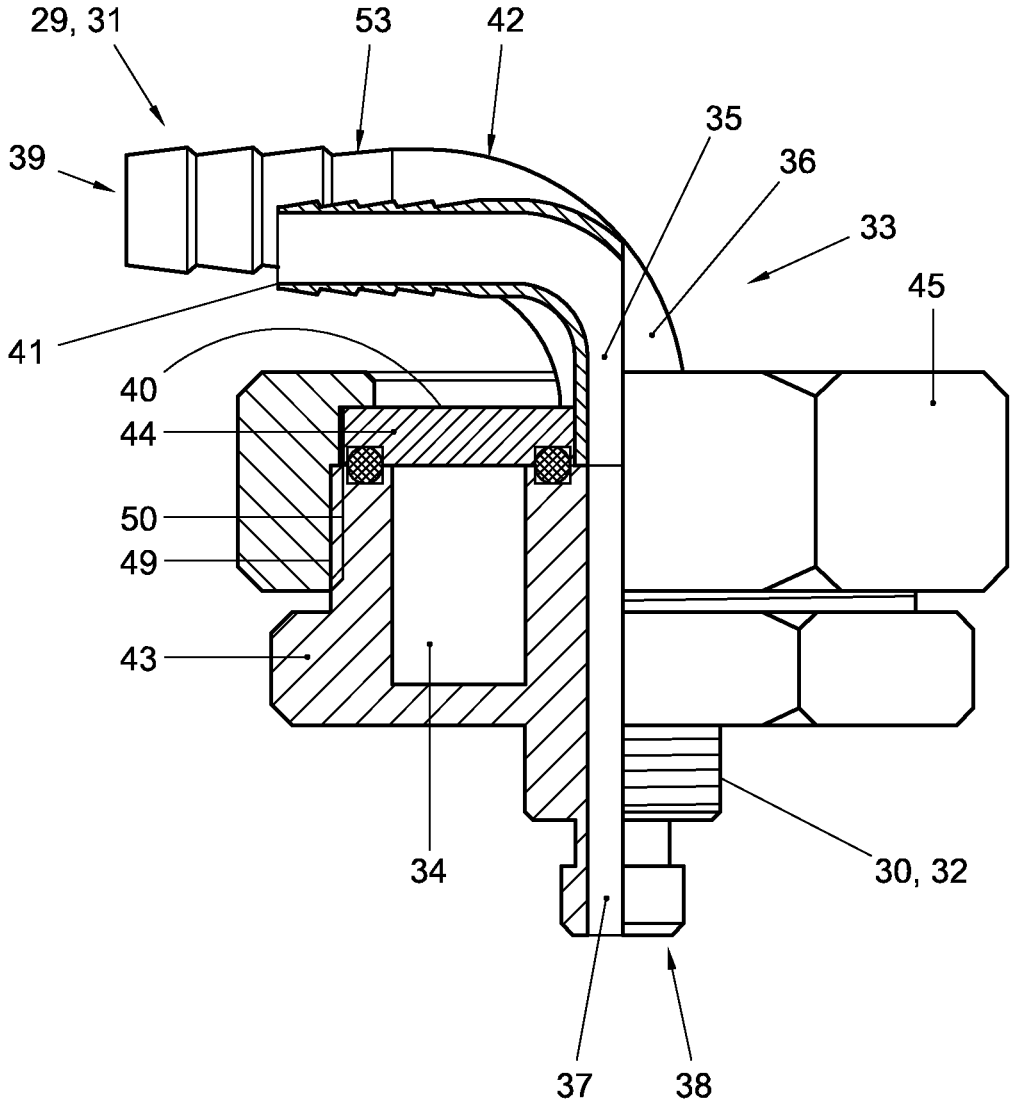
FIG. 3 shows schematically and partly sectioned in side elevation a cooling chamber-containing part for a tapping device according to FIG. 1 or a tapping head according to FIG. 2.
Figure 4:
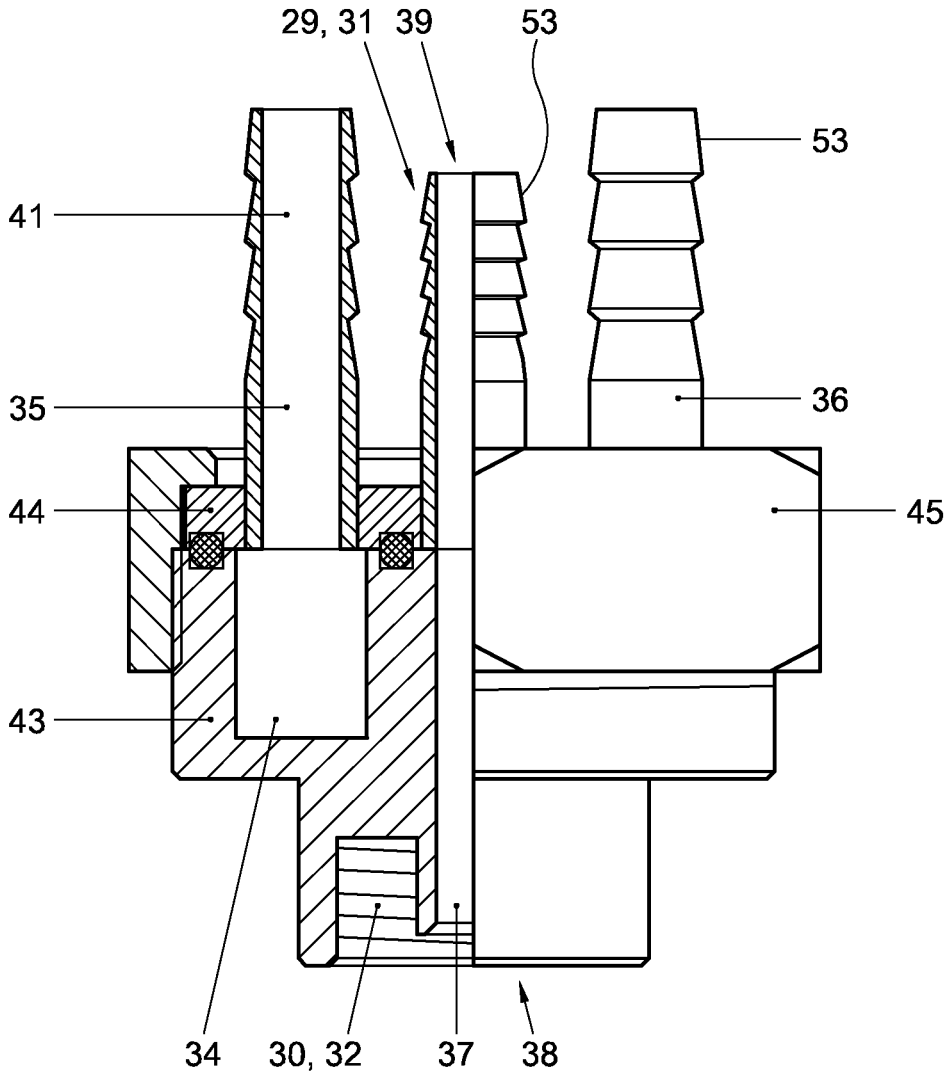
FIG. 4 shows schematically and partly sectioned in side elevation an alternative embodiment of a cooling chamber-containing part for a tapping device according to FIG. 1 or a tapping head according to FIG. 2.

In FIGS. 3 and 4, embodiments of connecting parts 33 are shown which may be included between, respectively, the gas line connection 27 and the gas line 13 and/or the beverage line connection 26 and the beverage line 7. In FIGS. 1 and 2 the connecting parts 33 are shown in the respective positions. The connecting part can form or comprise an uncouplable part, for instance uncouplable from coupling means 29, 30, 31, 32 and/or from a gas line, beverage line, gas line connection and/or beverage line connection. A connecting part 33 can comprise a cooling chamber 34, provided with an entrance 35 and an exit 36. A connecting part 33 can comprise a channel part 37, which may extend between a first end 38 and a second end 39. The first end 38 may be provided with a first counter coupling means 30 and the second end 39 with a corresponding first coupling means 29, for positioning between the gas line connection 27 and the gas line 13. The first end 38 may be provided with a second counter coupling means 32 and the second end 39 with a corresponding second coupling means 31, for positioning between the beverage line connection 26 and the beverage line 7. In an embodiment, the first and second coupling means 29, 31 may be compatible, while the first and second counter coupling means 30, 32 may likewise be compatible. In an embodiment, the first coupling means 29 may be substantially equal to the second coupling means 31, while the first counter coupling means 30 may be equal to the second counter coupling means 32. The connecting parts 33 may be universally applicable. In another embodiment, the coupling means 29, 30, 31, 32 may be so designed that there is a connecting part 33 for the gas line and one for the beverage line, which connecting parts 33 are not interchangeable. In another embodiment, there may be just a connecting part for the beverage line or for the gas line. In another embodiment, the respective line 7, 13 may be mounted on a coupling piece (not shown) which is provided with the respective counter coupling means 30, 32 and, for instance, is clamped tight in an end of the line 7, 13.

The coupling means 29, 30, 31, 32 and possibly the standard coupling means provided on a beverage or gas line are preferably mutually couplable in different combinations and form first, second, and third coupling means.

The or each connecting part 33 comprises a cooling chamber 34 which extends along or around the channel part 37 and preferably is substantially ring-shaped. The entrance 35 and exit 36 may then be provided on opposite sides of the channel part 37, for instance in an end face 40 of the connecting part 33. The entrance 35 and exit 36 can for instance comprise a pipe section 41, 42 having a longitudinal axis L which is approximately parallel to a longitudinal axis $L_k$ of the respective channel part 37 adjacent the cooling chamber 34. A supply part 8A of the cooling line 8 may be connected to the entrance 35, a discharge part 8B to the discharge 36, such that the cooling line 8 forms a circuit closed upon itself, of which the cooling chamber 34 or different cooling chambers 34 form a part. In the circuit mentioned, a pump may be included for pumping round a cooling medium. In an embodiment, the coolant may be water. In another embodiment, the cooling medium may be or comprise glycol or a like antifreeze or freezing temperature-lowering fluid. The cooling chamber 34 of a connecting part 33 can be thermally coupled with the housing of the tapping head 10, through coupling of the relevant coupling means. In an alternative embodiment, the connecting part 33 may be integrated with the housing and be in thermal contact therewith. The or each connecting part 33 may at least partly be manufactured from metal.

Figure 5:
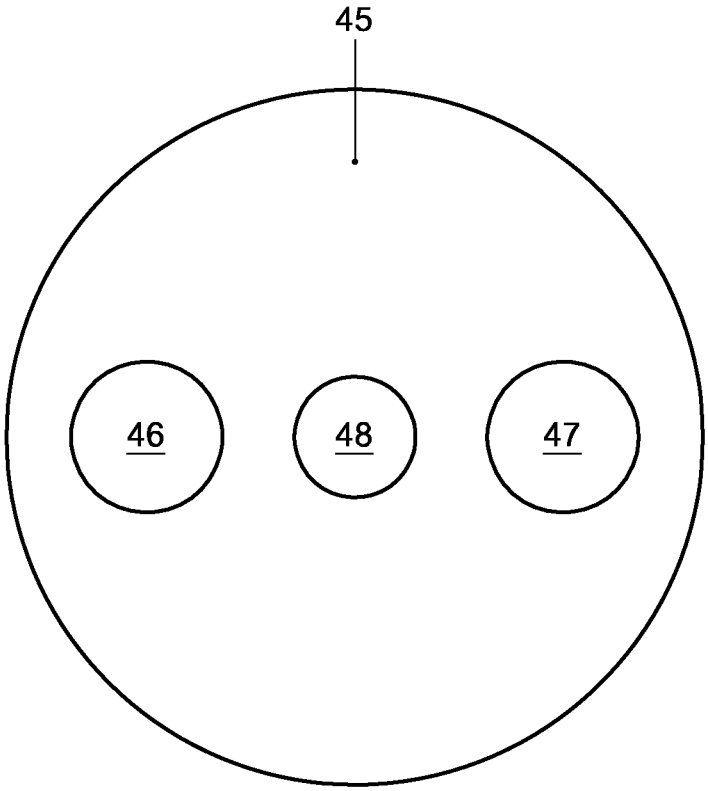
FIG. 5 shows a closing ring for a cooling chamber-containing part according to FIG. 3 or 4.

In the embodiments shown in FIGS. 3 and 4, a connecting part 33 is shown, comprising a base part 43, a locking plate 44, as for instance shown in FIG. 5, and a lock nut 45 with which the locking plate 44 is clamped against the base part 43. The pipe sections 41, 42 may be mounted in the locking plate 44, in openings 46, 47, for instance by clamping, welding, gluing, screwing, or be integrated therewith. Provided between the openings 46, 47 is a third opening 48, through which the channel part 37 can extend. A packing or like sealing may be provided between the locking plate 44 and the base part 43. In the base part 43 the cooling chamber 34 has been left open as an annular recess, which is closed off by the locking plate 44. In the embodiments shown, the base part 43 is provided with external thread 49, while the lock nut 45 is provided with complementary internal thread 50. By screwing the lock nut 45 onto the base part, the locking plate 44 is clamped tight and the cooling chamber 34 is sealed. The base part 43 is provided with the first end 38 with the first counter coupling means 30 or second counter coupling means 32, being screw thread in the embodiments shown. The second end 39 of the channel part 37 is provided with a profiling, such that a line 7, 13, such as for instance a plastic hose, can be clamped onto it and optionally may be secured with the aid of a clamp or other clamping means. The pipe sections 41, 42 may be comparably designed for coupling with a supply line 8A and discharge line 8B. In FIG. 3 the channel part 37 is substantially straight, in the embodiment of FIG. 4 the channel part is partly bent.

In the embodiments shown in FIGS. 1 and 2, both the beverage line connection and the gas line connection are provided with a connecting part 33. As indicated, also just one of these connections may be provided with a connecting part 33. Also, multiple connecting parts may be mutually coupled at one or more of the connections.

In FIG. 1 the exit 36 of one cooling chamber 34 is coupled with the entrance 35 of the other cooling chamber 34, so that they are included in series in the cooling circuit. However, they may also be coupled in parallel. Cooling medium that has been cooled in the cooling device 5 during use flows around the channel part 37 in the connecting part 33, and takes care of cooling of the connecting part 33. Through thermal contact between the respective connecting part 33 and the housing 20 of the tapping head 10, the tapping head is cooled. When the tapping head 10 is coupled with the container 2, in an embodiment, moreover, at least a part of the container 2 may be cooled. Beverage flowing through the tapping head 10 is thereby cooled. This has a positive effect on the quality of the beverage. Moreover, bacterial growth in and around the tapping head 10 is prevented or at least inhibited. In an advantageous embodiment, the tapping head 10 is largely surrounded by an insulating jacket 50, in FIG. 1 schematically represented in broken lines. The jacket 50 may for instance be formed from, or comprise, a foam body, for instance manufactured from polystyrene or mineral wool or other thermally insulating material, and may for instance have an average thickness of between 2 and 15 cm, more particularly between 3 and 10 cm. In an embodiment, the total thickness of the insulation jacket 50 may for instance be approximately 9 cm. Suitable materials and dimensions may naturally be simply chosen by a skilled person, depending for instance, but not exclusively, on the desired temperature of the tapping head, the cooling power of the cooling medium, the desired beverage temperature and other factors. The insulation jacket 50, which insulates at least thermally, provides the advantage that influences, in particular temperature influences from outside, are limited, so that the temperature of the tapping head 10 can relatively easily be kept low, for instance below 10 degrees Centigrade, more particularly below for instance approximately 8 degrees, more particularly below approximately 6 degrees. Where required, the temperature may even be adjusted to and held below approximately 4 degrees Centigrade with the aid of the cooling medium. At least the connecting head is substantially free of the insulation jacket 50. Moreover, the handle may be operated from outside the insulation jacket. In an alternative embodiment, the operating device for the shaft, instead of being remotely operable by a handle, may for instance be electrical, pneumatic or hydraulic.

The connecting parts 33 as shown in the figures are shown for illustration only. They may be built up and designed in many other ways. For instance, the cooling chamber 34 may have a different shape than a circular shape, the base part and the lock nut together can form the cooling chamber and the entrance and/or exit may be arranged at different positions with respect to the channel part 37. The volume of the cooling chamber(s) 34 or the joint cooling chambers 34 may be at least approximately 50% of the volume of the beverage channel in the tapping head 10. In an embodiment, this volume can be at least about 75% of the volume of the beverage channel in the tapping head, more particularly at least 100% thereof.

A tapping head 10 according to the invention may for instance be set up as follows.

An existing tapping head 10 may be uncoupled from a gas line 13 and/or a beverage line 7. Thereupon, a connecting part 33 can be arranged in the exposed gas line connection and/or beverage line connection, by mounting the first end 38 therein. Next, the gas line 13 and/or beverage line 7 can be coupled with the respective second ends 38. Moreover, the or each cooling line 8, 8A, 8B may be coupled with respective entrances and exits of the cooling chamber(s) 34 for forming the cooling circuit. An advantage of such a use of the invention may be that existing tapping heads 10 can be provided simply and relatively inexpensively with cooling means, while for cooling the cooling medium used for cooling, moreover, where desirable, use can be made of existing cooling means 5. Incidentally, also, tapping heads 10 may be directly provided with a connecting part and/or cooling chamber in for instance a part of the housing, as long as there is thermal contact between the cooling chamber and at least one of a beverage channel and a gas channel in the tapping head and/or a connecting head of the tapping head.

With a device according to this description, beverage can be tapped from a container, while the beverage in the container does not need to be cooled, or only slightly so, and yet can be dispensed in a cooled state. Moreover, the hygiene and the quality of the beverage can be preserved. Especially with beverage containing for instance natural ingredients such as yeast, hops or the like, such as beer, to date the beverage was cooled in the container. Which may be cumbersome, for instance because of the cooling volume, capacity and energy consumption. Those disadvantages can now be reduced or eliminated.

The invention is not in any way limited to the embodiments shown and described in the description and drawings. Many variations thereon are possible within the framework of the invention outlined by the claims. For instance, multiple casks or other containers may be connected to a tapping device 1 according to the invention, other cooling means may be used and other types of containers, such as for instance cellar beer containers, BIC or BIB type containers or other types of containers, may be used. Also, other types of tapping heads may be used and provided with a connecting part 33 according to the invention. Furthermore, other types of beverage may be tapped with a tapping device according to the invention.

The invention claimed is:

1. A tapping device, comprising:

a tapping head, provided with a connecting head near an end of a housing for connecting to a beverage container, wherein the tapping head is provided with:

a beverage channel which extends from a beverage line connection into the connecting head or a beverage channel which extends from a beverage line connection into the connecting head and a gas channel which extends from a gas line connection; and at least one connecting part connected to the tapping head, with at least one cooling chamber with an entrance and an exit, separate from the beverage channel and/or the gas channel of the tapping head, which cooling chamber is in thermal contact with the housing of the tapping head, wherein the at least one connecting part is provided between a gas line and the gas channel of a tapping line and/or between a beverage line and the beverage channel of the tapping head, wherein the at least one cooling chamber is provided in a part separable from the tapping head.

2. A tapping device according to claim 1, wherein the at least one cooling chamber extends around a connection for the gas line and/or a connection for the beverage line.

3. A tapping device according to claim 1, wherein the separable part is provided with a first counter coupling, which can cooperate with the beverage line connection or the separable part is provided with a second counter coupling which can cooperate with the gas line connection.

4. A tapping device according to claim 3, wherein the separable part is provided with a first coupling to which a coupling of a beverage line can be coupled, or a second coupling to which a gas line can be coupled, which coupling of the beverage line or gas line, with separable part removed, is also couplable with the beverage line connection or the gas line connection respectively.

5. A tapping device, comprising:

a tapping head, provided with a connecting head near an end of a housing for connecting to a beverage container, wherein the tapping head is provided with:

a beverage channel which extends from a beverage line connection into the connecting head or a beverage channel which extends from a beverage line connection into the connecting head and a gas channel which extends from a gas line connection; and at least one connecting part connected to the tapping head, with at least one cooling, chamber with an entrance and an exit, separate from the beverage channel and/or the gas channel of the tapping head, which cooling chamber is in thermal contact with the housing of the tapping head, wherein the at least one connecting part is provided between a gas line and the gas channel of a tapping line and/or between a beverage line and the beverage channel of the tapping head, wherein both at a beverage line connection and at a gas line coupling a separable part with a cooling chamber is provided.

6. A tapping device according to claim 5, wherein said cooling chambers are mutually connected by a line outside the housing.

7. A tapping device according to claim 1, wherein the tapping head is provided with an operating device extending through the housing for opening at least one valve in a cask coupled with the connecting head.

8. A tapping device according to claim 1, wherein the tapping head is provided with an insulation casing which substantially surrounds the housing and leaves at least the connecting head partly clear.

9. A tapping device according to claim 1, wherein the tapping head is connected to a cooling line of the tapping device, which cooling line is connected to a cooling system for beverage.

10. A tapping device according to claim 9, wherein the tapping head is connected to a cooling line which is part of a connection between the tapping head and a tapping column or tapping provision for dispensing beverage from a cask connected to the tapping head.

11. A tapping device according to claim 9, wherein the tapping head is connected to a python-type tapping line.

12. A tapping device according to claim 9, wherein the cooling line is connected to an in-line cooler.

13. A tapping device according to claim 9, wherein the cooling line and the tapping head are thermally insulated.

14. A tapping device according to claim 9, wherein the volume of the or each cooling chamber or the joint cooling chambers is at least approximately 50% of the volume of the beverage channel in the tapping head.

15. A method for cooling beverage in a tapping device, wherein coolant is guided through a cooling chamber connected to the tapping head, which coolant is also used for cooling the beverage in at least a part of a beverage line connecting to the tapping head, wherein the coolant is supplied to the tapping head and discharged from the tapping head via cooling lines which extend along and/or around at least a part of the beverage line within an insulating jacket.

16. A method according to claim 15, wherein the coolant is cooled in an in-line cooler.

17. A method for adapting a tapping head for cooling, comprising the steps of:

uncoupling a beverage line and/or gas line from a beverage line connection and/or a gas line connection of a tapping head, respectively;

coupling a cooling chamber-containing part, provided with a beverage line intermediate piece and/or a gas line intermediate piece with the beverage line connection and/or a gas line connection, respectively;

coupling the beverage line and/or the gas line, respectively, with the beverage line intermediate piece and/or the gas line intermediate piece, such that the beverage line intermediate piece is connected between the beverage line connection and the beverage line and/or the gas line intermediate piece is connected between the gas line connection and the gas line.

18. A method according to claim 17, wherein to the or each cooling chamber-containing part a coolant supply line and a coolant discharge line are connected.

19. A tapping head, provided with a connecting head near an end of a housing, wherein the tapping head is provided with at least one of a beverage channel which extends from a beverage line connection into the connecting head and a gas channel which extends from a gas line connection, wherein the tapping head is provided with at least one cooling chamber with an entrance and an exit, separate from the beverage channel and/or the gas channel, which cooling chamber is in thermal contact with the housing, wherein at least such cooling chamber is provided at a connection between a gas line and the gas channel.

* * * * *